US006626382B1

(12) United States Patent
Liu

(10) Patent No.: US 6,626,382 B1
(45) Date of Patent: Sep. 30, 2003

(54) SPRAY GUN AIR VOLUME ADJUSTMENT KNOB

(76) Inventor: Horng-Hsiang Liu, No. 8, Lane 45, Che Lu Tou St., San Chung City, Taipei Hsien (TW)

( * ) Notice: Subject to any disclaimer, the term of this patent is extended or adjusted under 35 U.S.C. 154(b) by 0 days.

(21) Appl. No.: 10/263,753

(22) Filed: Oct. 4, 2002

(51) Int. Cl.[7] ..... B05B 1/30; B05B 7/02

(52) U.S. Cl. ..... 239/569; 239/525; 239/526; 239/290; 239/296; 239/581.2

(58) Field of Search ..... 239/525, 526, 239/569, 290, 296, 600, 581.1, 581.2

(56) References Cited

U.S. PATENT DOCUMENTS 3,780,953 A * 12/1973 Malec ..... 239/526
5,732,886 A * 3/1998 Liaw ..... 239/526
6,131,825 A * 10/2000 Hsu ..... 239/526
2003/0025000 A1 * 2/2003 Schmon et al. ..... 239/296

* cited by examiner

*Primary Examiner*—Robin O. Evans
(74) *Attorney, Agent, or Firm*—Rosenberg, Klein & Lee

(57) ABSTRACT

An air volume adjustment knob for a spray gun is provided at the rear end of the spray gun, a threaded opening connected through an airway to accommodate a tube, a ring, a bonnet, a spring and a bolt; a hole being provided in the tube; a shaft containing a screwed hole being protruded from one end of the tube; a polygonal block being formed at the end of the shaft; the ring with a threaded section being sleeved onto the shaft of the tube; a retaining hole being axially formed in the center of the bonnet; and an index being protruded from the bonnet; thus, the ring and the tube being fixed to the opening then secured with the bonnet in relation to the polygonal block of the tube to merely fix the tube to the opening with the ring and to control on and off of the airway through the hole of the tube by turning the bonnet.

4 Claims, 6 Drawing Sheets

SPRAY GUN AIR VOLUME ADJUSTMENT KNOB

BACKGROUND OF THE INVENTION (a) Field of the Invention

The present invention relates to an air volume adjustment knob of a spray gun, and more particularly, to one provides improved safety and easier operation.

(b) Description of the Prior Art

Whereas a spray gun of the prior art operates on the air supply from an external source and an adjustment knob is provided on the spray gun to regulate the air volume as the job requires. The adjustment knob found with spray guns generally available in the market, as illustrated in FIGS. 5 and 6 of the accompanying drawings is to provide at the rear end of a spray gun (A) an opening (A2) that is connected through an airway (A1). A reduced lateral hole (A3) is provided at the front end of the opening (A2) to merely allow the insertion of a control lever (A6) subject to the movement from a trigger (A5) of the spray gun (A) and the control lever (A6) penetrates through a leak proof sleeve (A7) screwed to the front end of the hole (A3). A sealing block (A61) is fixed to the rear end of the control lever (A6) to plug into and seal up the hole (A3) so that the hole (A3) is secluded from the opening (A2). The hole (A3) is connected to a longitudinally provided passage (A4) and connected through the outlet of a nozzle (A8). A knob structure (B) to adjust the air volume is provided in the rear end of the opening (A2). The knob structure is essentially comprised of a knob (B1) fixed to the top of a tube (B2) and a groove (B11) at an angle approximately of 270 degrees is provided in recess on the circumference of the knob (B1). The groove (B11) has its terminal secured and linked to the tube (B2), and a hole (B21) is provided in the tail of the tube (B2). When assembled, a spring (C) is placed into the tube (B2) of the knob (B1) and the tube (B2) is then inserted into the opening (A2) of the spray gun (A). A pin (D) is inserted into the spray gun (D) and rests in the groove (B11) of the knob (B1) thus to prevent the knob (B1) from being ejected. The inner end of the spring (C) holds against the sealing block (A61) of the control lever (A6) to block up the hole (A3). Once the spray gun (A) is in use, the knob (B1) is turned for the groove (B11) to move along the pin (D) for a certain angle thus to relatively drive the tube (B2) to merely have the hole (B21) in the tail of the tube (B2) to be aligned with the airway (A1). The trigger (A5) of the spray gun (A) is pulled to push the control lever (A6) inserted in the sleeve (A7) inside the opening (A2), and the sealing block (A61) is driven to push against the spring (C) and retreats from the hole (A3) to permit the air in the airway (A1) to flow through the hole (B21) in the tube (B2) into the opening (A2), where the air enters into the hole (A3) through a void formed as a result that the sealing block (A61) clears away from the hole (A3) and then flows through the path (A4) in the nozzle (A8) to provide the air required by the nozzle (A8).

However, the prior art is found with the following defectives. Reasons are first the knob structure is held in position essentially by having a pin with a very limited length of threaded tip to lock and hold against the groove of the knob thus to prevent the knob from escaping axially and to limit the turning angle of the knob. After use for a certain time, the pin is vulnerable to loosen up due to friction with the knob, which is frequently turned clockwise and counter-clockwise. The continuous supply of air also causes the knob to be easily ejected due to the return force of the spring and the air pressure. The ejected knob presents serious threaten to the safety of the holder of the spray gun. Furthermore, it is also a problem upon placing the tube containing the spring into the opening. As force must be continuously applied to compress the spring while aligning the groove in the knob to the pin before inserting and screwing in the pin, the force has to be applied in two directions at the same time, it becomes awkward for the holder of the spray gun and it is usually ejected by accident due to the return force of the spring.

SUMMARY OF THE INVENTION

The primary purpose of the present invention is to provide an air volume adjustment knob for a spray gun that is safe and easy to use. To achievement the purpose, in the rear end of the spray gun, an opening internally threaded, and connected through an airway is provided to accommodate a tube, a ring, a bonnet and a spring. Wherein, a hole is provided in the tube; a shaft containing a screwed hole is protruded from one end of the tube; a polygonal block is formed at the end of the shaft; a threaded section is provided on the outer wall of the ring; and a retaining hole corresponding to the shape of the polygonal block is formed axially in the bonnet. The ring is sleeved onto the shaft and secured to the opening of the spray gun by means of the threaded section of the ring. The bonnet is screwed to the tube with the retaining hole of the bonnet aligned to the polygonal block of the tube so that the tube is secured into the opening of the spray gun by the ring to adjust the output of the air volume through the hole of the tube as driven by the turning bonnet.

DETAILED DESCRIPTION OF THE PREFERRED EMBODIMENTS

Figure 1:
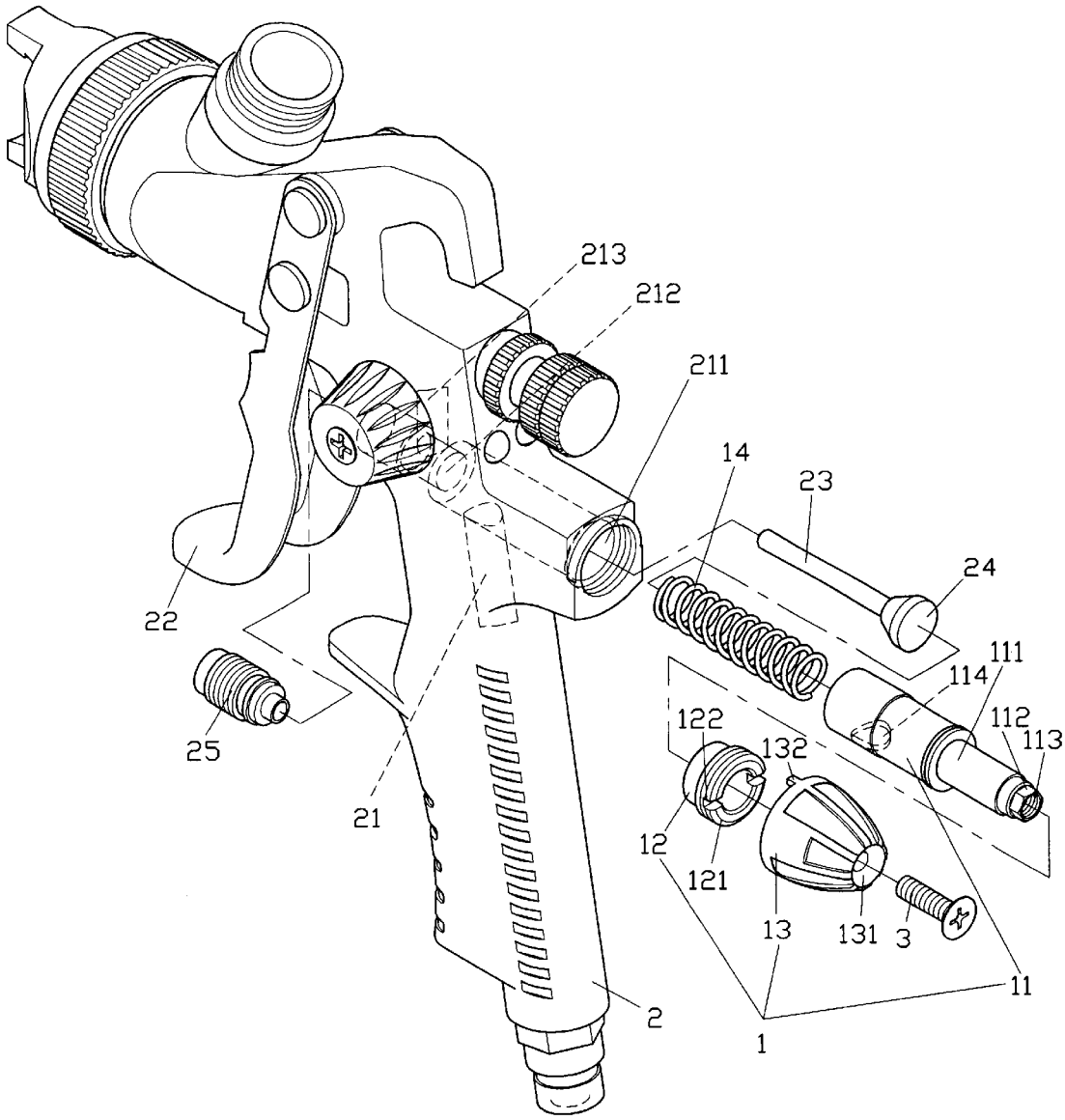
FIG. 1 is an exploded view of the present invention.

Referring to FIG. 1, a knob (1) of the present invention is essentially comprised of a tube (11), a ring (12), a bonnet (13), a spring (14) and a bolt (3) adapted to a spray gun (2).

An opening (211), internally screwed and connected to an airway (21), is provided in the rear end of the spray gun (2). A reduced hole (212) is transversally provided at the front end of the opening (211) to accommodate insertion of a control lever (23), which is subject to the control by a trigger (22) of the spray gun (2) and is positioned to the spray gun (2) after penetrating through a sleeve (25) screwed for leak proof at the front end of the hole (212). A sealing block (24) is fixed to the tail of the control lever (23) to seal up the hole (212) so that both of the hole (212) and the opening (211) are separated from each other. A path (213) longitudinally provided and connected to the hole (212) is further connected through an output of a nozzle (a part of the structure of a spray gun generally known to those who are familiar with the art, thus detailed description is not provided herein or is touched only to the extent that it is related to the present invention hereinafter.) The knob (1) as disclosed below is accommodated in the rear end of the opening (211).

A shaft (111) provided with a hexagonal block (112) is protruded from one end of the tube (11). A screwed hole (113) is axially provided at one end of the shaft (111), and a hole (114) is provided in the periphery of tube (11).

The ring (12) is formed with a threaded section (121) around the outer wall, and a pair of grooves (122) are provided to be turned and moved by a certain tool.

The bonnet (13) has inside formed an axially connected through retaining hole (131) corresponding to the shape of the block (112) of the tube (11), and an index (132) is protruded from the bonnet (13).

Figure 2:
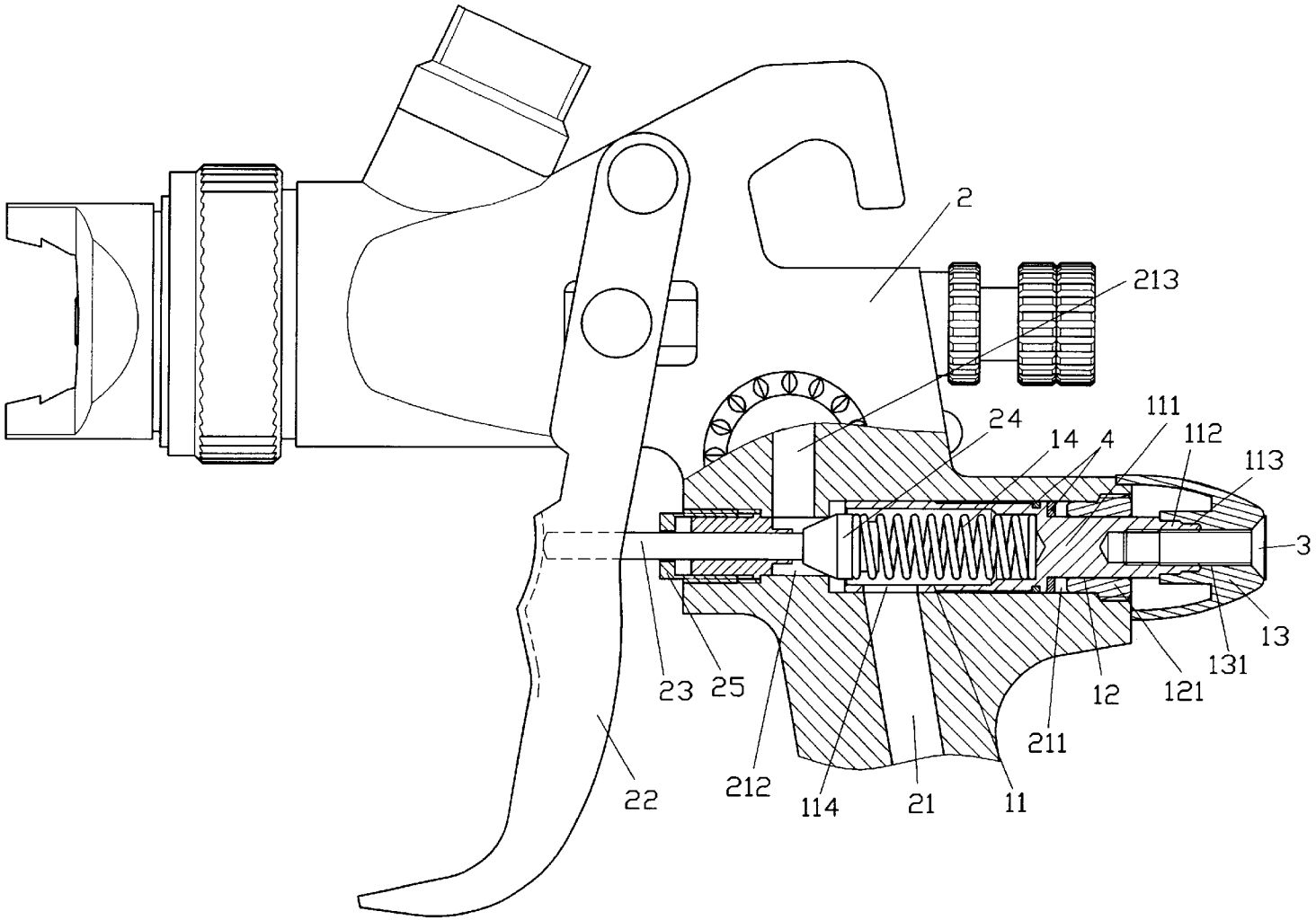
FIG. 2 is a sectional view of the present invention as assembled with airway opened up.

When assembled as illustrated in FIG. 2, the spring (14) is placed inside the tube (11) and a plurality of washers (4) are sleeved onto the shaft (111). The shaft (111) is sleeved with the ring (12) so that both of the ring (12) and the tube (11) are accommodated in the opening (211). The sealing block (24) at one end of the control lever (23) through the hole (212) is merely having its end to rest on the spring (14) while the bonnet (13) is engaged the tube (11) with the retaining hole (131) aligned to the block (112) of the tube (11). Finally, the bolt (3) is screwed into the bonnet (13) through the screwed hole (113) in the tube (11) to secure the knob (1) for air volume adjustment of the spray gun (2).

Figure 3:
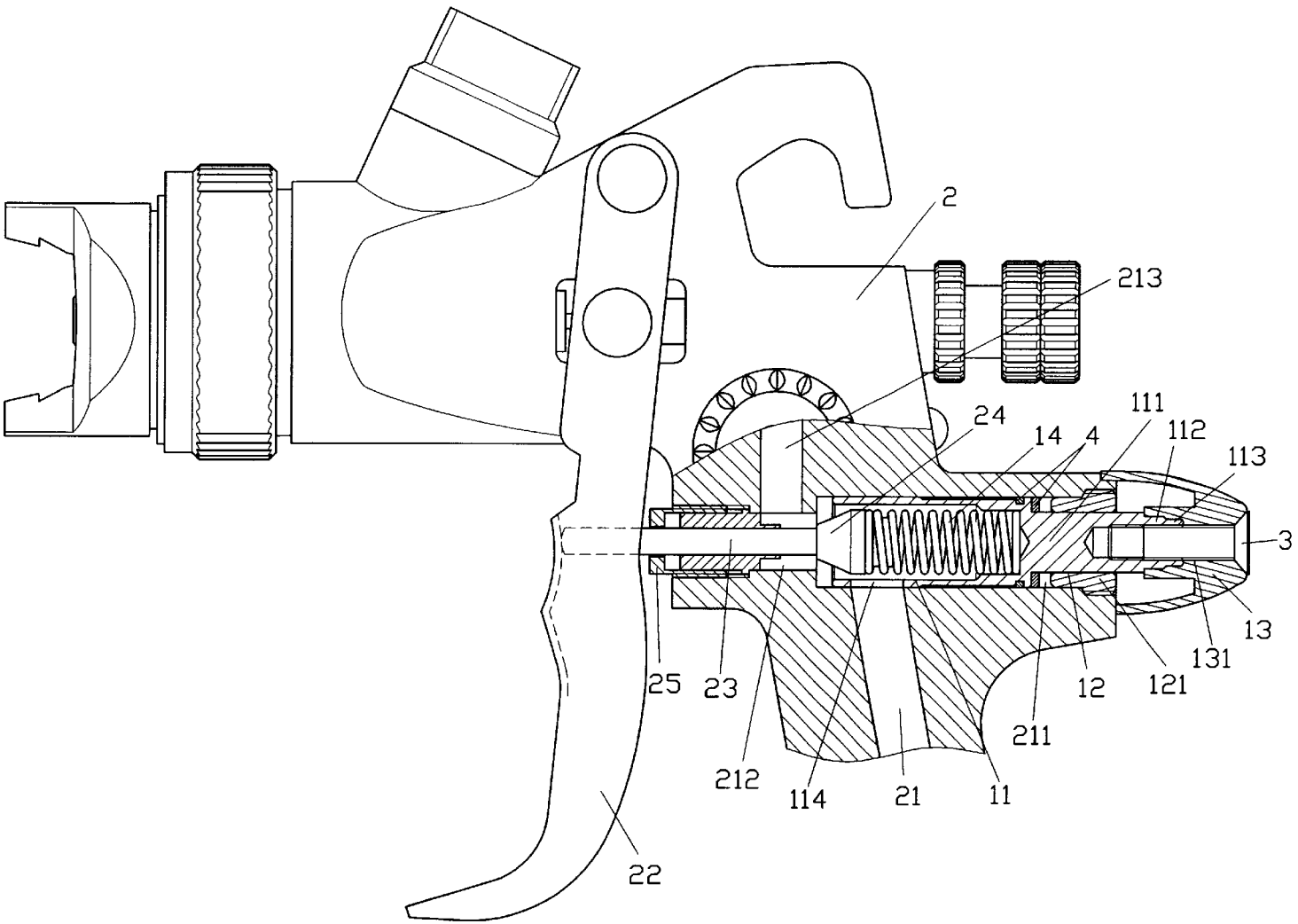
FIG. 3 is a view showing that the present invention is in operation.

Now referring to FIG. 3, the air volume is adjusted by turning the bonnet (13) until the index (132) on the edge of the bonnet (13) is turned to the center along with the bonnet (13) while the retaining hole (131) in the bonnet (13) as linked to the shaft (111) of the tube (11) also turns for the hole (114) of the tube (11) to be overlapped with the airway (21) of the spray gun (2) thus to permit the air to flow out of the airway (21). The size of the air volume is regulated depending on that of the overlapped area by the hole (114) of the tube (11) and the airway (21). Once the trigger (22) of the spray gun (2) is pulled, the trigger (22) pushes the control lever (23) in the opening (211) and further to push the sealing block (24) to hold against the spring (14) for the spring (14) to retreat. Meanwhile, a path is formed by the hole (212) to admit the air in the airway (21) to flow in through the opening (211), and then to flow into the path (213) leading to the nozzle through a path formed as the sealing block (24) opens up to supply the air required by the nozzle.

Figure 4:
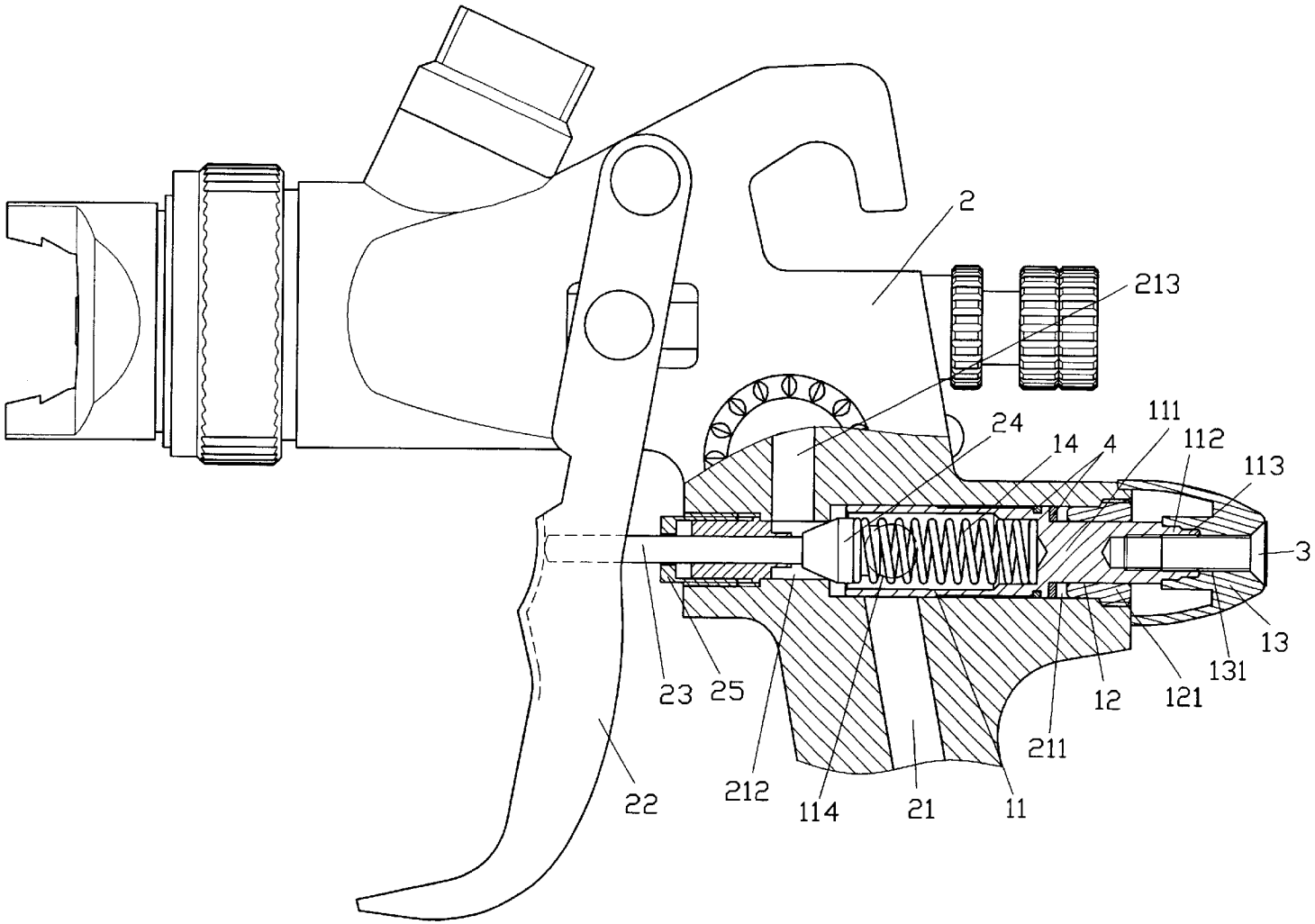
FIG. 4 is a view showing that the airway of the present invention is closed.
Figure 5:
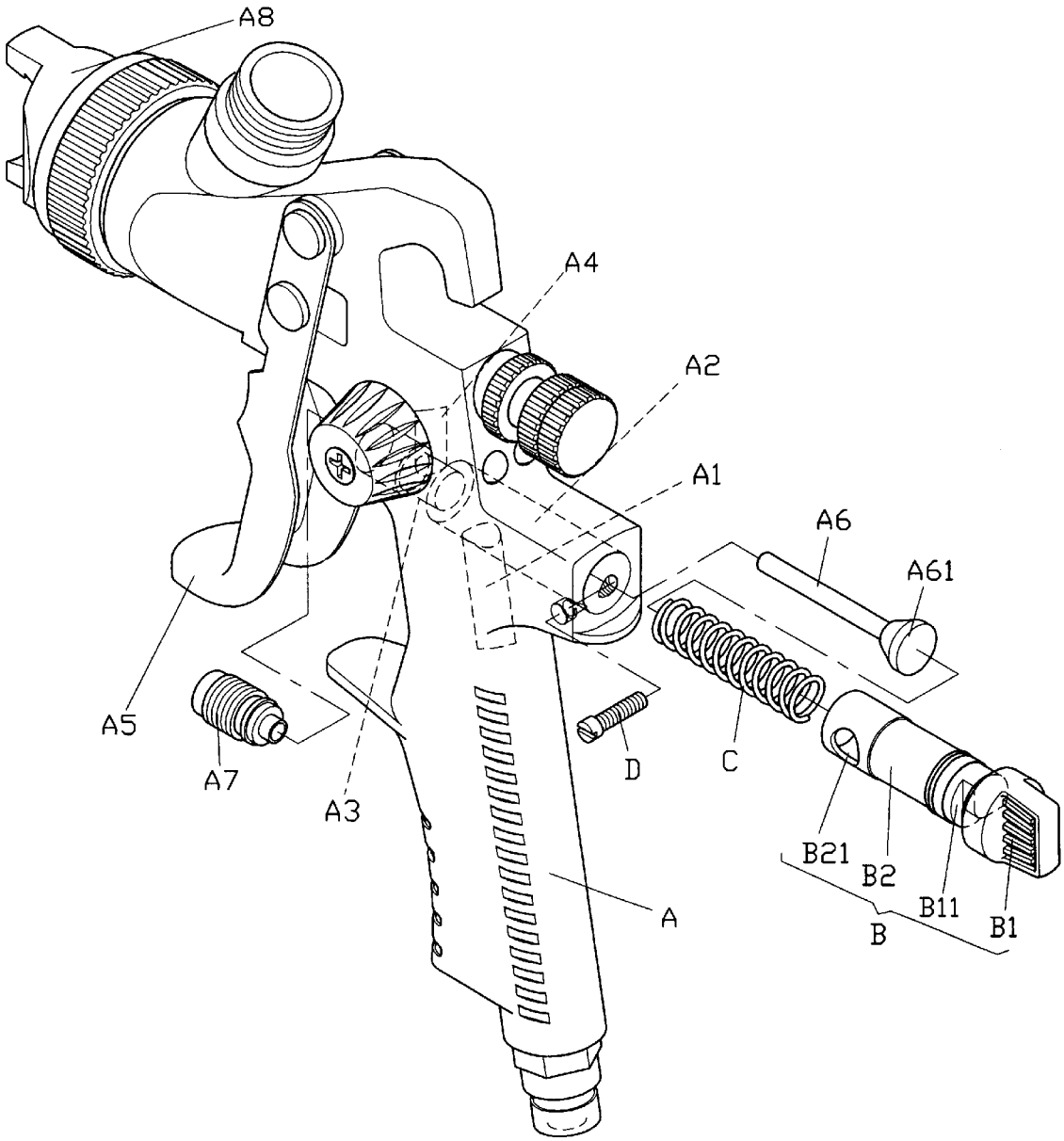
F I G . 5 (PRIOR ART)
FIG. 5 is an exploded view showing a structure of a prior art.
Figure 6:
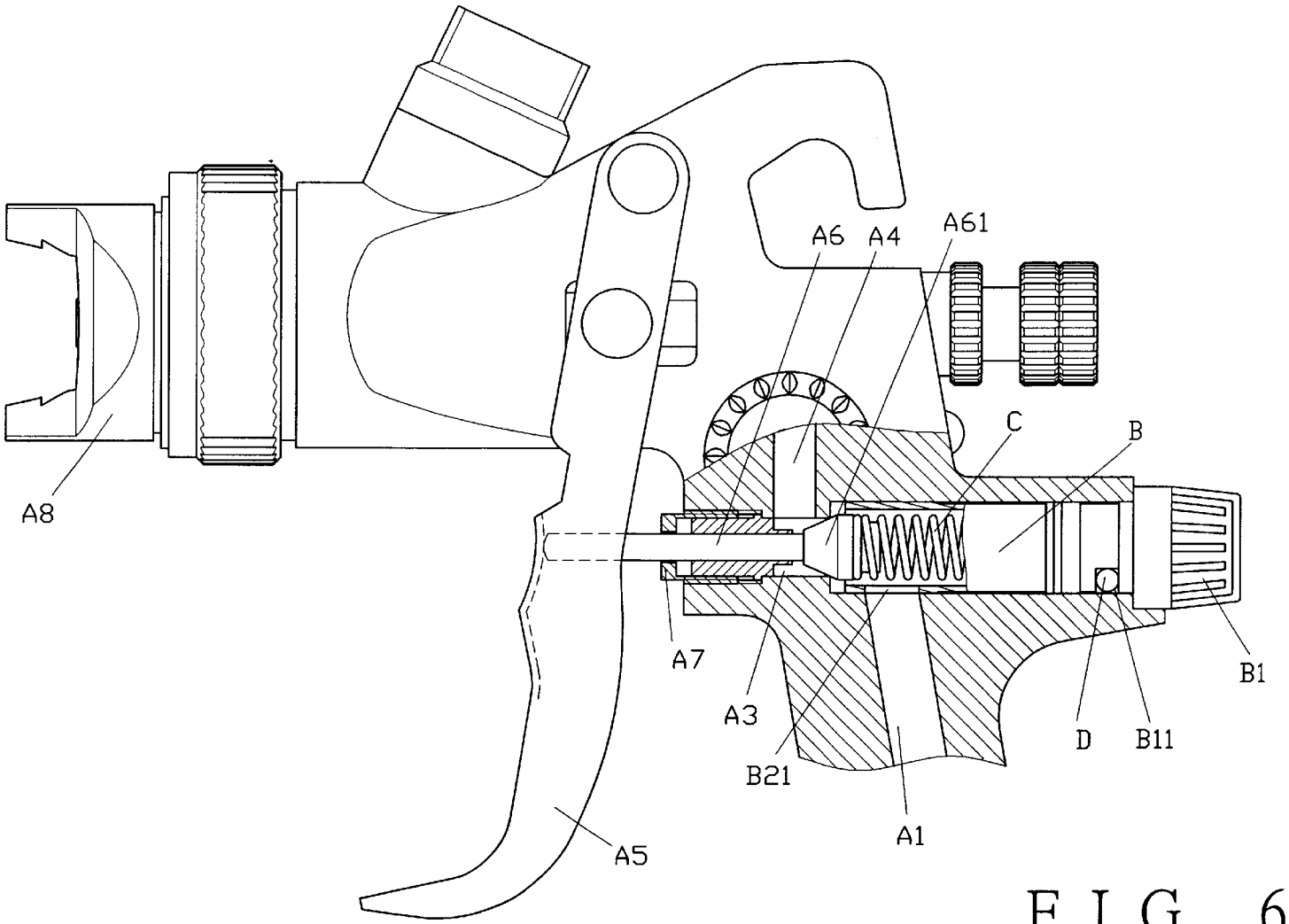
FIG. 6 (PRIOR ART)
FIG. 6 is a sectional view of the prior art as assembled.

On the contrary when the air supply is closed as illustrated in FIG. 4, the bonnet (13) is turned either clockwise or counter-clockwise for the retaining hole (131) in the bonnet (13) to turn as linked to the tube (11) for the screwed hole (113) in the tube (11) to clear away from the airway (21) to close up the airway (21) by the circumference of the tube (11).

The present invention does provide the following significant improvements:

1. As the knob of the present invention is screwed to the opening in the spray gun by means of a threaded ring, and turned by the hole in the tube controlled by the bonnet, the knob will not be entirely lost, or ejected to hurt the holder of the spray gun even the bolt on the bonnet is loosening up.
2. The knob of the present invention is easy to operate since the bonnet allows opening or closing the air outlet in both directions. The purpose of achieving a tight close is done either by turning the knob clockwise or counter-clockwise.
3. The knob of the present invention is easy for assembly with improved safety. It permits well-facilitated operation without fearing the ejection of the tube due to the return force of the spring since the ring is inserted to the shaft and the tube is used to compress the spring and securely screwed in the opening of the spray gun and the force applied as well as the screw in are done in the same direction.

I claim:

1. An air volume adjustment knob for a spray gun essentially comprising an opening provided in a rear end of the spray gun that is connected through an airway to accommodate a knob; characterized by that:

the knob including a tube, a ring, a bonnet, a spring and a bolt; a hole being provided in the tube; a shaft being protruded from one end of the tube; a polygonal block being formed at one end of the shaft; the ring being sleeved onto the shaft; and a retaining hole corresponding to the shape of the polygonal block of the tube being axially provided at the center inside the bonnet;

both of the ring and the tube being fixed in the opening of the spray gun; the retaining hole of the bonnet being inserted in relation to the polygonal block of the tube; the tube being secured in the opening of the spray gun by the ring and the tube being linked to the turning of the bonnet.

2. The air volume adjustment knob for a spray gun as claimed in claim 1, wherein, an inner wall of the opening is threaded; and a threaded section being respectively provided on the outer wall of the ring to secure the ring to the opening.

3. The air volume adjustment knob for a spray gun as claimed in claim 1, wherein, a screwed hole is axially provided through the shaft; the retaining hole of the bonnet being axially connected through to receive the bolt; the bolt being screwed to the shaft of the tube; and the bonnet being linked to the shaft.

4. The air volume adjustment knob for a spray gun as claimed in claim 1, wherein, an index is protruded from the bonnet to indicate on or off status of the bonnet.

* * * * *